US007573029B2

(12) United States Patent
Heninger et al.

(10) Patent No.: US 7,573,029 B2
(45) Date of Patent: Aug. 11, 2009

(54) ION TRAP WITH LONGITUDINAL PERMANENT MAGNET AND MASS SPECTROMETER USING SAME

(75) Inventors: Michel Heninger, Etiolles (FR); Joël Lemaire, Antony (FR); Gérard Mauclaire, Limours (FR); Pierre Boissel, Fontenay les Briis (FR)

(73) Assignees: Centre National de la Recherche Scientifique, Paris (FR); Universite Pierre et Marie Curie-Paris VI, Paris (FR); Universite de Paris 11 - Paris Sud, Orsay (FR)

( * ) Notice: Subject to any disclaimer, the term of this patent is extended or adjusted under 35 U.S.C. 154(b) by 406 days.

(21) Appl. No.: 11/659,075

(22) PCT Filed: Aug. 2, 2005

(86) PCT No.: PCT/FR2005/002013

§ 371 (c)(1),
(2), (4) Date: Feb. 1, 2007

(87) PCT Pub. No.: WO2006/024775

PCT Pub. Date: Mar. 9, 2006

(65) Prior Publication Data

US 2008/0296494 A1 Dec. 4, 2008

(30) Foreign Application Priority Data

Aug. 5, 2004 (FR) ..... 04 08678

(51) Int. Cl.
*H01J 49/42* (2006.01)
*H01J 49/36* (2006.01)

(52) U.S. Cl. ..... 250/291; 250/292; 250/293; 250/282; 250/281; 250/396 ML

(58) Field of Classification Search ..... 250/291, 250/292, 293, 281, 282, 396 ML
See application file for complete search history.

(56) References Cited

U.S. PATENT DOCUMENTS

| | | | | |
|---|---|---|---|---|
| 5,451,781 | A | 9/1995 | Dietrich et al. | |
| 6,989,533 | B2 * | 1/2006 | Bellec et al. | 250/291 |
| 7,227,133 | B2 * | 6/2007 | Glish et al. | 250/288 |

FOREIGN PATENT DOCUMENTS

| | | |
|---|---|---|
| EP | 0 462 554 | 12/1991 |
| FR | 2 835 964 | 8/2003 |

* cited by examiner

*Primary Examiner*—Nikita Wells
(74) *Attorney, Agent, or Firm*—Young & Thompson

(57) ABSTRACT

A vacuum magnetic ion trap includes an assembly forming a permanent magnet including at least two magnetized structures (30, 32) in the form of hollow cylinders, one convergent radial structure, magnetized along a convergent radial direction, and one divergent radial structure, magnetized along a divergent radial direction, the convergent and divergent radial magnetized structures (30, 32) being arranged along a common longitudinal axis (XX') The trap also includes a sealed chamber (4) containing anion confinement cell (8) fixed between the at least two magnetized structures (30, 32) and including at least two trapping electrodes (10) connectable to a voltage generator (12).

15 Claims, 4 Drawing Sheets

ION TRAP WITH LONGITUDINAL PERMANENT MAGNET AND MASS SPECTROMETER USING SAME

FIELD OF THE INVENTION

The present invention relates to a vacuum magnetic ion trap suitable in particular for being used to detect ions by Fourier transform ion cyclotron resonance (FTICR) mass spectrometry.

BACKGROUND OF THE INVENTION

Magnetic ion traps, or Penning traps, serve to confine ions for long periods of time, to cause them to react with neutral gases, so that they can subsequently be selected by their mass and thus detected with very high resolution in terms of mass.

They are used in a variety of fields going from atomic physics to proteomics.

The advantage of such devices for characterizing macromolecules leads to using magnetic fields of ever increasing intensity so as to increase sensitivity, resolving power and the range of masses that can be detected. High intensity fields, at present of the order of 12 Tesla, are obtained using superconductor magnets. Such devices are bulky and can weigh as much as several (metric) tonnes. In addition, they require complex power supply and cooling installations, and they are therefore usable only in fixed installations.

Traps of smaller size, suitable for providing a mobile device, have been developed by using permanent magnets to generate the magnetic field (L. C. Zeller, J. M. Kennady, J. E. Campana, H. I. Kenttamaa, Anal. Chem. 1993, 65, 2116-2118, U.S. Pat. No. 5,451,781 DIETRICH).

Nevertheless, when the magnetic field is restricted to values of about 0.4 Tesla and/or to values that are too small, performance is very limited.

In order to obtain good performance, in particular concerning resolution, a fundamental parameter is good uniformity of the magnetic field, and a field intensity of about 1 Tesla is often considered as being a necessary order of magnitude.

The permanent magnet described in French patent application FR 2 835 964 serves to obtain a uniform field of good quality and intensity, but the geometry used limits use of the trap to ions that are formed directly in the cell or in its immediate vicinity.

SUMMARY OF THE INVENTION

The object of the present invention is to remedy that problem by defining a magnetic ion trap of small bulk and weight while preserving good performance and presenting geometry that is practical, and in particular that makes it possible to use an ion source that is external to the device.

The invention provides a vacuum magnetic ion trap comprising an assembly forming a permanent magnet comprising at least two magnetic structures in the form of hollow cylinders and a sealed enclosure containing an ion confinement cell placed between said at least two magnetic structures and having at least two trapping electrodes connectable to a voltage generator, the trap being characterized in that said permanent magnet-forming assembly comprises at least one radially converging magnetic structure magnetized in a radially converging direction, and at least one radially diverging magnetic structure magnetized in a radially diverging section, said radially converging and diverging magnetic structures being disposed on a common longitudinal axis so as to generate between them a uniform permanent magnetic field oriented in a direction substantially parallel to said longitudinal axis.

According to other characteristics of the invention:

- said at least two magnetic structures are formed by combining magnetic elements that are assembled together to form said structures;
- a hollow cylindrical intermediate part of high magnetic permeability is disposed between said at least two magnetic structures, coaxially about the same axis;
- said intermediate part is a structure magnetized along the longitudinal axis going from the radially diverging magnetic structure towards the radially converging magnetic structure;
- said magnetic structures are spaced apart from one another along the longitudinal axis by predetermined non-zero gaps;
- it includes means for adjusting the positions of said magnetic structures relative to one another;
- said confinement cell further includes two measurement electrodes connectable to measurement means in order to convey information relating to the movements of ions contained in said confinement cell;
- said confinement cell further includes two excitation electrodes connectable to an excitation signal generator in order to excite ions contained in said confinement cell;
- said treatment enclosure includes means for connection to pump means in order to control the density and/or the nature of the atmosphere in the enclosure;
- it includes an external ion source outside the central magnetic field zone, said external ion source being connected to the enclosure via an ion transfer zone having means for guiding ions towards the cell;
- said external ion source is a source of ions at atmospheric pressure;
- said external ion source is an external ion source of the matrix-assisted laser desorption ionization (MALDI) type; and
- said external ion source is a drift tube or a flow tube.

The invention also provides a mass spectrometer comprising a magnetic ion trap, a pump device, a trapping voltage generator, and measurement means suitable for performing Fourier transform ion cyclotron resonance analysis of ions contained in the ion trap, characterized in that said magnetic ion trap is a trap as defined above.

BRIEF DESCRIPTION OF THE DRAWINGS

The invention will be better understood on reading the following description given purely by way of example and made with reference to the accompanying drawings, in which.

DETAILED DESCRIPTION OF THE PREFERRED EMBODIMENTS

Figure 1:
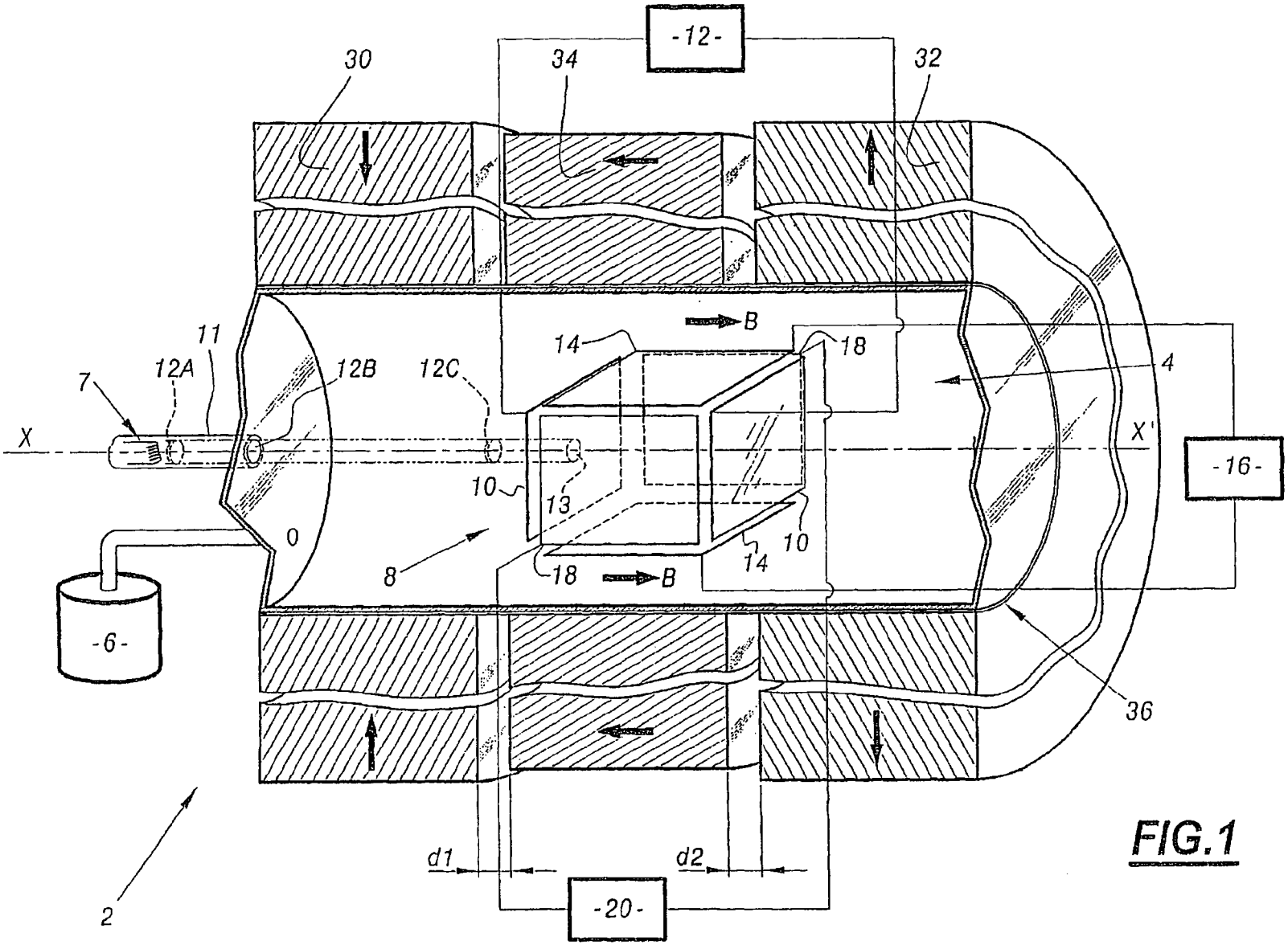
FIG. 1 is a diagram showing the principles of a mass spectrometer fitted with an ion trap of the invention and shown in a view that is partially in section.

The Fourier transform ion cyclotron resonance (FTICR) mass spectrometer shown in FIG. 1 is fitted with a magnetic ion trap 2 of the invention.

The magnetic ion trap 2 comprises a sealed enclosure 4 of generally cylindrical shape about a longitudinal axis XX', also referred to as a treatment enclosure. The enclosure 4 is connected to a pump device 6.

In the embodiment described, the pump device 6 is constituted by a turbomolecular pump associated with a diaphragm pump. Naturally, other types of pump could be used, such as ion pumps, cryogenic pumps, or any other equivalent device. The device 6 serves to establish an ultrahigh vacuum in the enclosure 4 at a pressure of about $10^{-8}$ millibars.

The device 6 also includes pipes for injecting gas that are connected to the enclosure 4 via a combination of leak valves and pulsed valves for controlling the nature of the atmosphere within the enclosure 4.

The mass spectrometer is designed to be used with an external source of ions, such as a filament 7 that emits electrons along the longitudinal axis, and gas-injection pipes as described above.

An ion-confinement cell 8 in which ions can be analyzed by mass is placed inside the enclosure 4 on the axis XX'. Various shapes are possible for the cell.

In the example, the cell 8 is in the form of a cube and includes two trapping electrodes 10 of plane and square shape extending parallel to each other and perpendicularly to the longitudinal axis XX' of the enclosure 4.

To enable ions to be introduced into the confinement cell 8, the enclosure 4 has leaktight connection means 11 disposed between the source 7 and the enclosure 4 on the axis XX', and ion guide means 12 that are formed in this example by a plurality of lenses connected to a generator, comprising an accelerator lens 12A, a focusing lens 12B, and a decelerator lens 12C.

Furthermore, the trapping electrode situated beside the external source 7 is pierced by a hole 13 so as to enable ions to be injected into the cell 8.

The electrodes 10 are electrically connected to a direct current (DC) generator 12 in order to be charged electrically to a predetermined potential for trapping purposes.

The cell 8 also includes two excitation electrodes 14 of plane and square shape extending parallel to each other, perpendicularly to the trapping electrodes 10, and perpendicularly to the longitudinal axis XX' of the enclosure 4.

The excitation electrodes 14 are electrically connected to an excitation signal generator 16.

Finally, the cell 8 includes two measurement electrodes 18 of plane and square shape extending parallel to each other and perpendicularly to the trapping electrodes 10 and also to the excitation electrodes 14. The measurement electrodes 18 are connected to a measurement device 20 constituted for example by a broad-band preamplifier connected to a microcomputer fitted with electronic signal-acquisition cards and suitable analysis software.

The trapping, excitation, and measurement electrodes 10, 14, and 18 are disposed in such a manner that the cell 8 is generally in the form of a cube, or more generally of a rectangular parallelepiped.

For example, the cubic cell 8 is made using square electrodes having a side of 20 millimeters (mm) or 25 mm, made of a non-magnetic material such as ARCAP AP4, for example, mounted on an insulated support made of MACOR, and electrically connected by means of wires made of copper or silver.

The ion trap 2 also includes an assembly forming a permanent magnet which, in the embodiment described, comprises three hollow cylindrical structures about the longitudinal axis and respectively referenced 30, 32, and 34. In this example, the structures are made by combining a plurality of magnetized segments that are assembled in such a manner as to present the general shape of a hollow cylinder of circular section.

The three magnetic structures 30, 32, and 34 are disposed on the same longitudinal axis XX', i.e. coaxially about and axially along the axis XX', with the structure 34 being interposed between the structures 30 and 32 that are referred to as outer structures.

The structures 30, 32, and 34 thus form a cavity 36 in which the treatment enclosure 4 is placed so that the confinement cell 8 is located between the outer magnets 30 and 32 on the longitudinal axis XX'.

In the example described, the center of the confinement cell 8 corresponds essentially to the center of the assembly of magnetic structures 30, 32, and 34.

Figure 3:
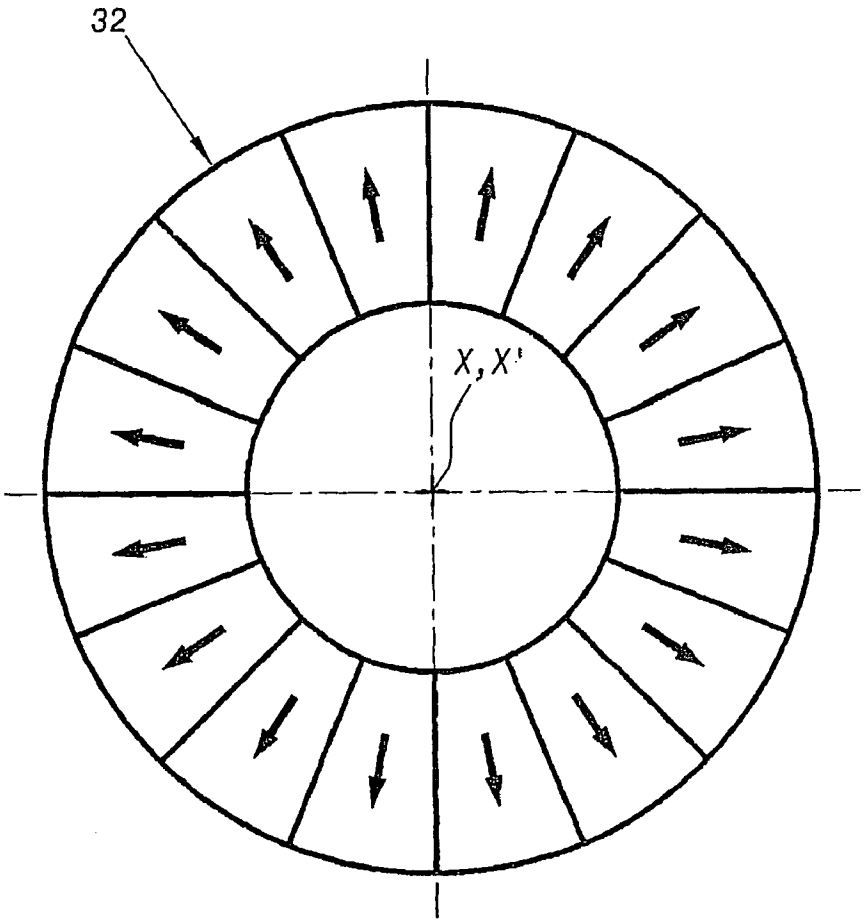
FIGS. 2 and 3 are cross-sections of permanent magnets used in the invention.
Figure 2:
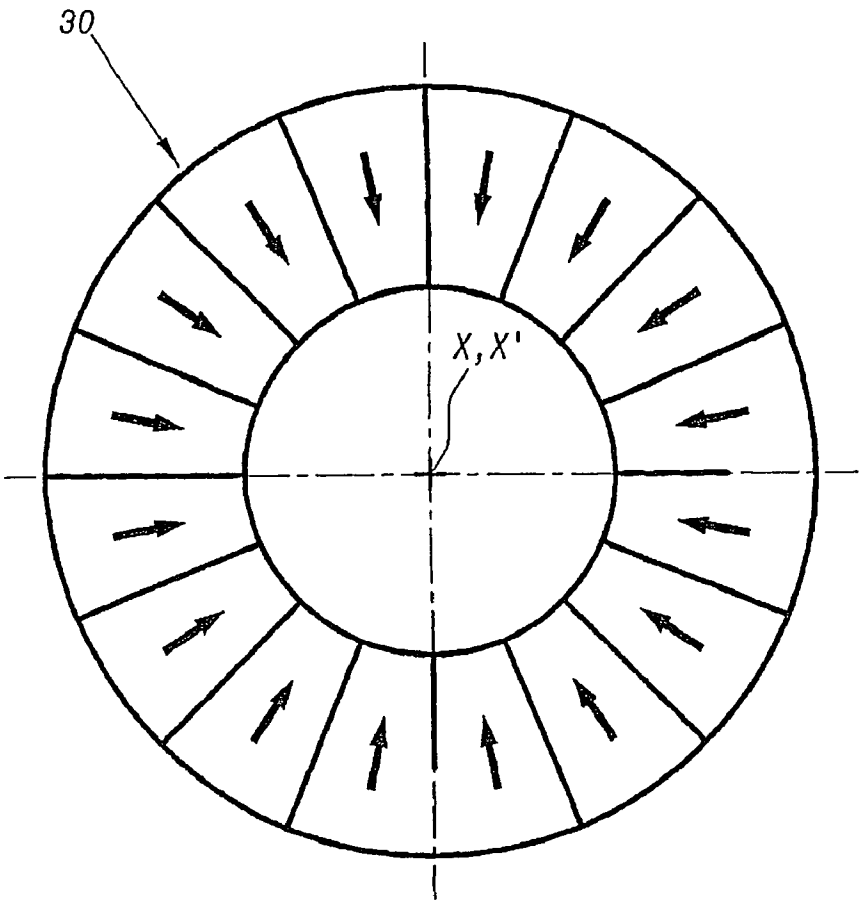

The outer magnetic structures 30 and 32, described in greater detail with reference to FIGS. 2 and 3, are designed in such a manner as to induce respectively a substantially radial magnetic field that converges and a substantially radial magnetic field that diverges.

As shown in the section view of FIG. 2, the converging radial magnetic structure 30 is made up of sixteen magnetized segments each in the form of a portion of a ring. The magnetization of each of the segments is along a converging radial direction, i.e. towards the axis XX'.

In similar manner, the section view in FIG. 3 of the structure 32 shows that this diverging radial structure is formed by assembling sixteen magnetized segments each in the form of a portion of a ring. Each of the segments is magnetized in a diverging radial direction, i.e. away from the axis XX'.

In addition, in the embodiment described, the orientation of each segment forming the magnetic structures 30 and 32 is essentially perpendicular to the axis XX', each structure presenting circular symmetry about the axis XX'.

Within the confinement cell 8 placed between the outer structures 30 and 32, co-operation between the magnetic structures 30 and 32 generates a uniform permanent magnetic field B extending substantially parallel to the longitudinal axis XX' in the direction going from the converging radial structure 30 towards the diverging radial structure 32.

Thus, the trapping electrodes 10 of the confinement cell 8 are placed perpendicularly to the magnetic field B generated by the magnets 30 and 32. This directed uniform permanent magnetic field B is reinforced in the embodiment described by the magnetic structure 34 interposed between the magnetic structures 30 and 32. The structure 34 is formed by magnetic segments magnetized parallel to the axis XX' and directed from the structure 32 towards the structure 30, i.e. from the diverging radial structure towards the converging radial structure.

The use of this magnetic structure 34 interposed between the structures 30 and 32 serves to reinforce the uniformity and the intensity of the magnetic field in the confinement cell 8, and also serves to ensure that the magnetic field outside the magnetic structures is weaker.

The dimensions of the magnets making up these structures 30 and 32 and also 34 are instrumental in determining the intensity of the field and its uniformity.

For example, the structures 30, 32, and 34 are constituted by neodymium-iron-boron (Nd—Fe—B) and they present an outside diameter of 24 centimeters (cm) for the magnetic structures 30 and 32 and of 20 cm for the magnet 34. All of the magnetic structures present an inside diameter of 6 cm and a length of 10 cm. The assembly then generates a magnetic field of the order of one Tesla with uniformity of the order of 1 part in 1000 within a central volume that is greater than about 10 cubic centimeters ($cm^3$).

In the embodiment described with reference to FIG. 1, the three magnetic structures 30, 32, and 34 are disposed coaxially and they are spaced apart axially by adjustable gaps d1 and d2.

With the dimensions selected for the magnets 30, 32, and 34, the gaps d1 and d2 are typically less than 5 mm, advantageously lying in the range 0.3 mm to 0.7 mm, and they are preferably equal to 0.5 mm.

Figure 4:
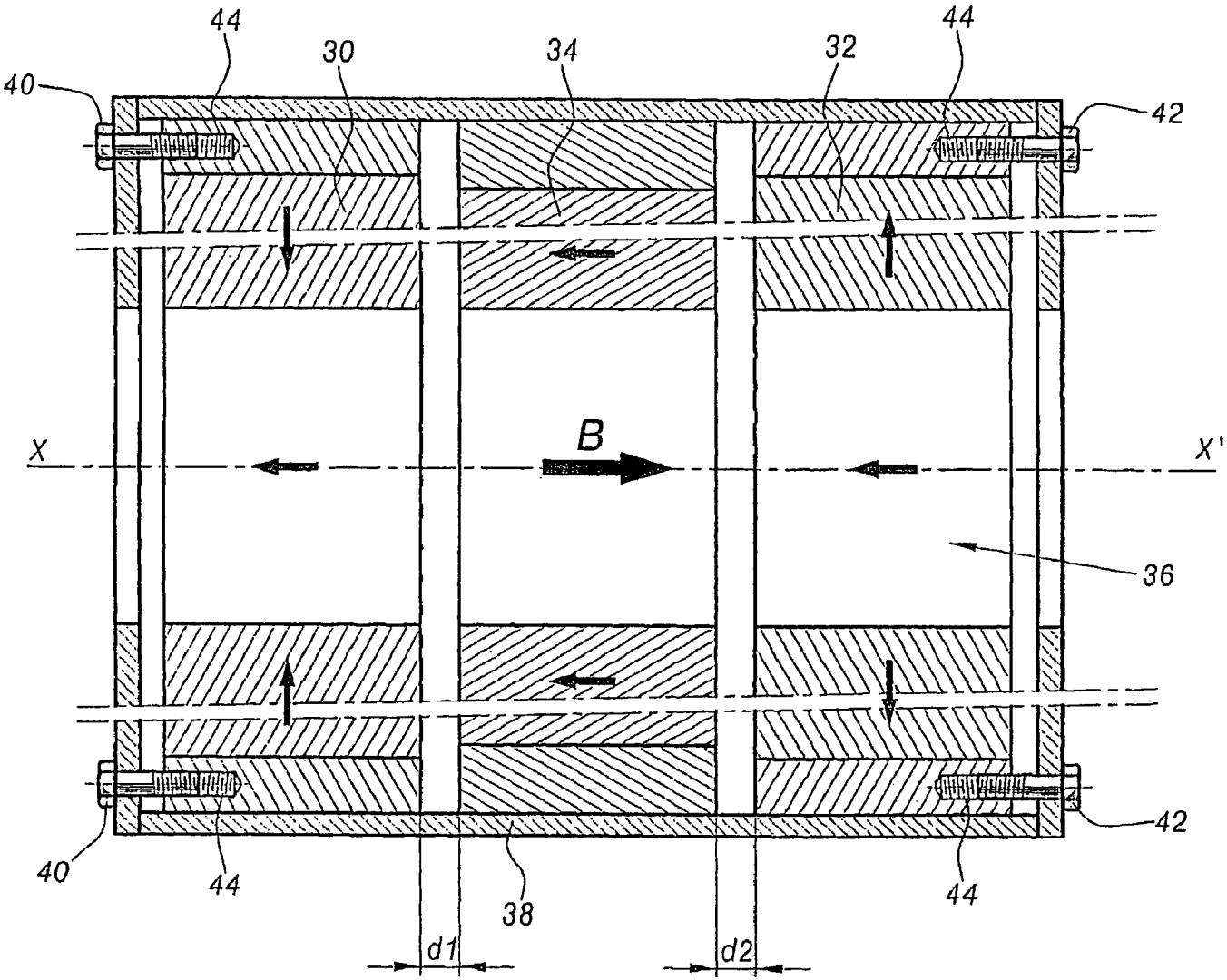
FIG. 4 is a longitudinal section view of permanent magnets used in the invention.

One way of mounting the magnets 30, 32, and 34 is shown in FIG. 4 which is a longitudinal section view showing the structures of the ion trap of the invention.

In order to make it easy to adjust the gaps d1 and d2, the central magnet 34 is mounted stationary on a frame 38 made of plates and spacers of non-magnetic material. The two outer magnetic structures 30 and 32 are mounted to be movable in translation and they can be displaced along the axis XX', e.g. by means of respective screws 40 and 42 secured to the frame 38 and engaging in tapped blind holes 44 provided in the outside faces of the outer magnets 30 and 32.

The gaps d1 and d2 are adjusted to obtain a magnetic field of maximum uniformity within the cell 8.

When disposed in this way, the structures 30, 32, and 34 generate in the center of the cavity 36 a uniform magnetic field B of high intensity, substantially parallel to the axis XX', and oriented from the structure 30 towards the structure 32.

Conversely, in the zones outside the cavity 36, it can be seen that there exists a uniform permanent magnetic field oriented parallel to the longitudinal axis and in the direction opposite to the distance of the field within the cell, i.e. going from the structure 32 towards the structure 30.

The operation of this mass spectrometer is close to that described in French patent application FR-2 835 964, and it is not described in greater detail herein.

Figure 5:
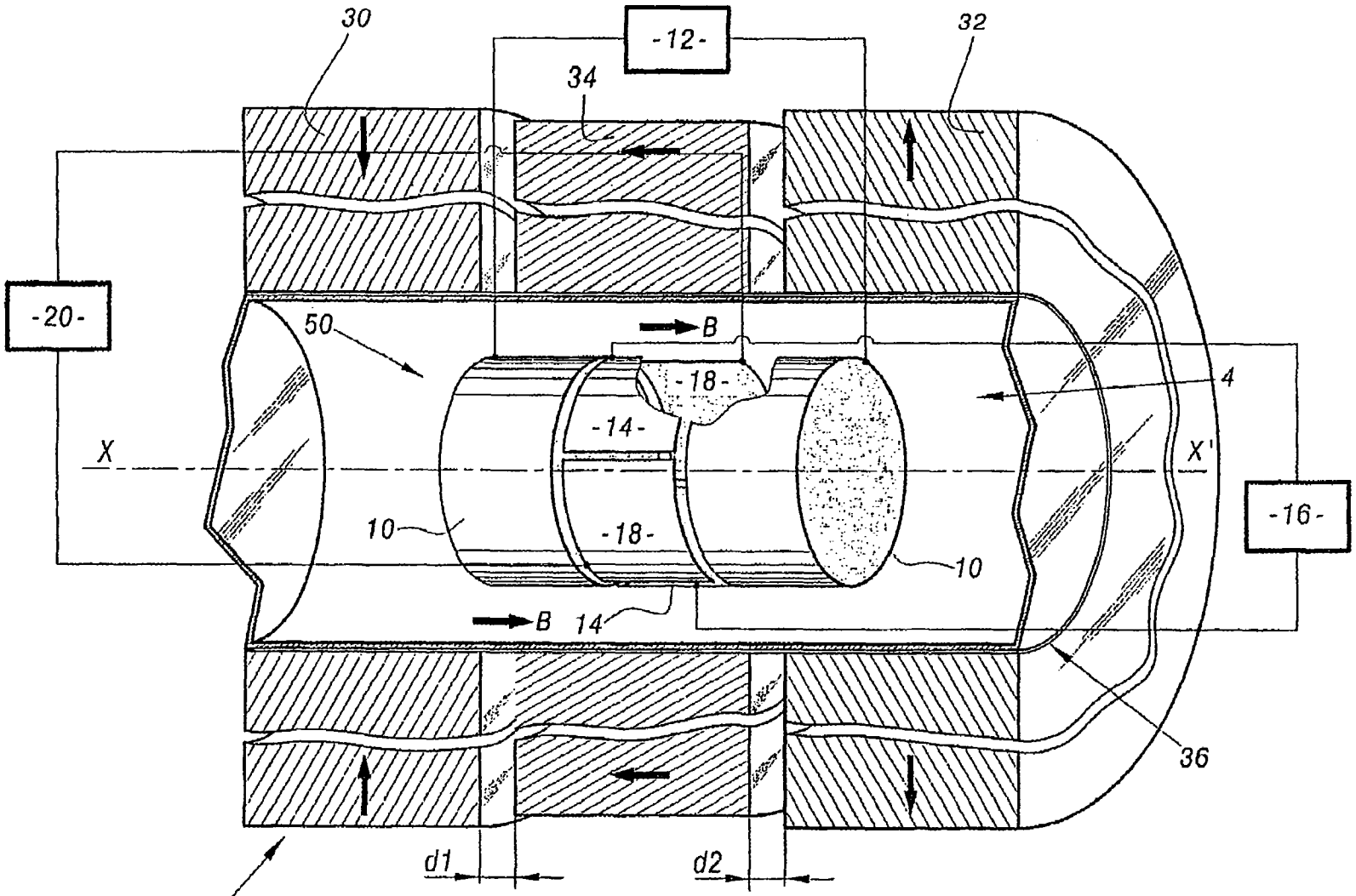
FIG. 5 is a perspective view of another embodiment of the ion trap of the invention.

With reference to FIG. 5, there follows a description of a second embodiment of the invention.

This figure is a perspective view partially in section of a magnetic ion trap 2 on the axis XX'.

As above, the ion trap 2 comprises the enclosure 4 integrated in the cavity 36 of the cylindrical magnetic structures 30, 32, and 34.

In this embodiment, each of the two trapping electrodes 10 is constituted by a cylindrical structure that is open via two opposite faces.

The openings of the two open cylinders constituting the electrodes 10 face towards each other along the longitudinal axis XX'.

The two excitation electrodes 14 and the two detection electrodes 18 are all in the form of ring sections and they are arranged in such a manner as to form a hollow cylinder placed between the hollow cylinders forming the trapping electrodes 10, and on the same axis. Same-type electrodes face one another, so the excitation electrodes 14 and the detection electrodes 18 alternate.

The set of electrodes thus defines a confinement cell 50 within the enclosure 4 that is generally in the form of a tunnel extending along the longitudinal axis XX'.

Such a structure can be defined as an open structure and presents numerous implementation advantages, in particular for ionizing molecules present in the enclosure 4 and for characterizing ions by interactions with beams of photons or other molecules.

Naturally, other forms of cell could be used, in particular a cubic cell in the form of a tunnel similar to that described in patent application FR 2 835 964.

In a variant, the ion trap of the invention is used directly with an external ion source, i.e. a source situated outside the zone of the central magnetic field. Ions should be injected into the cell along the axis of symmetry of the magnetic structures. The source may optionally be placed off the axis, providing an ion beam deflector device is placed upstream from ion introduction into the cell. The zone used for transferring ions must itself be placed in a high vacuum and may require one or more additional pump units.

The ions are guided along the axis XX' in conventional manner, e.g. with the help of a system made up of electrostatic lenses or of radiofrequency guides.

In operation, in an example making use of ion formation by chemical ionization, a sample of gas for producing primary ions is introduced into the ion source. A second sample of gas is then introduced in pulsed manner into the source so that the primary ions can react therewith. The ions that are produced are guided into the confinement cell where they are trapped and can be excited in such a manner as to obtain a mass spectrum by Fourier transform analysis.

The ion source itself may operate in a vacuum, e.g. by forming ions by electron impact, by chemical ionization, by laser ionizing ablation, or by matrix-assisted laser desorption ionization (MALDI). Sample changing is made easier by using separate pump units for the external source and for the remainder of the device, it being possible to isolate the external source with the help of a valve.

The external source may also be a source operating at atmospheric pressure (an electrospray source, an atmospheric pressure MALDI source, a source operating by chemical ionization at atmospheric pressure) in which case a plurality of differential pump stages are necessary between the ion source and the enclosure containing the cell.

It is also possible to use other types of source, such as drift tubes or flow tubes or any other type of source placed inside the enclosure or outside it.

In other embodiments, other shapes and assemblies of permanent magnets are used. For example, the magnets can be integrated inside the treatment enclosure or can be of shapes other than shapes of circular section, for example shapes of polygonal section.

In a variant, the outer magnetic structures are adapted to induce respective converging and diverging radial fields that are not perpendicular to the axis XX'. Thus, each field is oriented over a range of about 10° around the perpendicular to the longitudinal axis XX'.

The embodiment described has three magnetic structures, however two magnetic structures suffice for implementing the invention. In a variant, another structure may be interposed between those two magnetic structures coaxially about the same axis. This additional structure is made using a material that is not permanently magnetized but that presents high magnetic permeability, such as a piece of soft iron or some other ferromagnetic metal.

The invention claimed is:

1. A vacuum magnetic ion trap comprising an assembly forming a permanent magnet made up of at least two magnetic structures in the form of hollow cylinders and a sealed enclosure containing an ion confinement cell placed between said at least two magnetic structures and having at least two trapping electrodes connectable to a voltage generator, wherein said permanent magnet-forming assembly comprises at least one radially converging magnetic structure magnetized in a radially converging direction, and at least one radially diverging magnetic structure magnetized in a radially diverging section, said radially converging and diverging magnetic structures being disposed on a common longitudinal axis so as to generate between them a uniform permanent magnetic field oriented in a direction substantially parallel to said longitudinal axis.

2. A vacuum magnetic ion trap according to claim 1, wherein said at least two magnetic structures are formed by combining magnetic elements that are assembled together to form said structures.

3. A vacuum magnetic ion trap according to claim 1, wherein a hollow cylindrical intermediate part of high magnetic permeability is disposed between said at least two magnetic structures, coaxially about the same axis.

4. A magnetic ion trap according to claim 3, wherein said intermediate part is a structure magnetized along the longitudinal axis going from the radially diverging magnetic structure towards the radially converging magnetic structure.

5. A magnetic ion trap according to claim 1, wherein said magnetic structures are spaced apart from one another along the longitudinal axis by predetermined non-zero gaps.

6. A magnetic ion trap according to claim 4, including means for adjusting the positions of said magnetic structures relative to one another.

7. A magnetic ion trap according to claim 5, including means for adjusting the positions of said magnetic structures relative to one another.

8. A magnetic ion trap according to claim 1, wherein said confinement cell further includes two measurement electrodes connectable to measurement means in order to convey information relating to the movements of ions contained in said confinement cell.

9. A magnetic ion trap according to claim 1, wherein said confinement cell further includes two excitation electrodes connectable to an excitation signal generator in order to excite ions contained in said confinement cell.

10. A magnetic ion trap according to claim 1, wherein said treatment enclosure includes means for connection to pump means in order to control the density and/or the nature of the atmosphere in the enclosure.

11. A magnetic ion trap according to claim 1, including an external ion source outside the central magnetic field zone, said external ion source being connected to the enclosure via an ion transfer zone having means for guiding ions towards the cell.

12. A magnetic ion trap according to claim 11, wherein said external ion source is a source of ions at atmospheric pressure.

13. A magnetic ion trap according to claim 11, wherein said external ion source is an external ion source of the MALDI type.

14. A magnetic ion trap according to claim 11, wherein said external ion source is a drift tube or a flow tube.

15. A mass spectrometer comprising a magnetic ion trap, a pump device, a trapping voltage generator, and measurement means suitable for performing Fourier transform ion cyclotron resonance analysis of ions contained in the ion trap, wherein said magnetic ion trap is a trap according to claim 1.

* * * * *